US008690604B2

(12) United States Patent
Davis

(10) Patent No.: US 8,690,604 B2
(45) Date of Patent: Apr. 8, 2014

(54) RECEPTACLE ASSEMBLY

(75) Inventor: Wayne Samuel Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 217 days.

(21) Appl. No.: 13/276,769

(22) Filed: Oct. 19, 2011

(65) Prior Publication Data

US 2013/0102192 A1 Apr. 25, 2013

(51) Int. Cl.
*H01R 13/648* (2006.01)
*H01R 12/16* (2006.01)

(52) U.S. Cl.
CPC ..... *H01R 23/688* (2013.01)
USPC ..... 439/607.07

(58) Field of Classification Search
USPC ..... 439/108, 607.06–607.08, 607.34, 439/607.56, 712
See application file for complete search history.

(56) References Cited

U.S. PATENT DOCUMENTS 4,846,727 A * 7/1989 Glover et al. ..... 439/607.07
6,299,484 B2 * 10/2001 Van Woensel ..... 439/607.07
7,267,515 B2 * 9/2007 Lappohn ..... 439/607.07
7,621,760 B1 * 11/2009 Barr et al. ..... 439/79
7,744,380 B2 * 6/2010 Shuey et al. ..... 439/79
7,789,708 B2 * 9/2010 Laurx et al. ..... 439/108
7,862,376 B2 * 1/2011 Sypolt et al. ..... 439/607.07
7,927,143 B2 4/2011 Helster et al.
7,988,491 B2 * 8/2011 Davis et al. ..... 439/607.27
8,267,721 B2 * 9/2012 Minich ..... 439/607.05
8,382,522 B2 * 2/2013 Glover et al. ..... 439/607.08
8,469,745 B2 * 6/2013 Davis et al. ..... 439/607.07
8,616,919 B2 * 12/2013 Stoner ..... 439/607.07
2010/0144201 A1 * 6/2010 Defibaugh et al. ..... 439/607.05

* cited by examiner

*Primary Examiner* — Neil Abrams
*Assistant Examiner* — Travis Chambers

(57) ABSTRACT

A receptacle assembly includes a front housing having a mating end and a loading end. A contact module is coupled to the loading end and includes a frame assembly having a plurality of contacts and a dielectric frame supporting the contacts. The dielectric frame has first and second sides and channels between the contacts that extend at least partially through the dielectric frame between the first and second sides. The contacts extend from the dielectric frame for electrical termination. Ground conductors are received in corresponding channels and provide electrical shielding between corresponding contacts. A ground shield is coupled to the first side. The ground shield has side shields that extend along sides of the contacts to provide electrical shielding along sides of the contacts. The ground shield has shield tabs that engage corresponding ground conductors to electrically connect the ground shield to the ground conductors.

20 Claims, 7 Drawing Sheets

RECEPTACLE ASSEMBLY

BACKGROUND OF THE INVENTION

The subject matter herein relates generally to grounding structures in connector assemblies.

Some electrical systems utilize electrical connectors to interconnect two circuit boards, such as a motherboard and daughtercard. Signal loss and/or signal degradation is a problem in known electrical systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical connectors are placed in close proximity to each other.

Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, with a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, in some known systems, the electrical connectors include contact modules that provide 360° shielding around the signal contacts entirely through the electrical connector. The shielding is provided by a metal or metalized holder that holds dielectric frames, which in turn hold the signal contacts. Such connectors include many parts and the metal or metalized holders may be expensive to manufacture.

A need remains for an electrical system having improved shielding to meet particular performance demands.

BRIEF DESCRIPTION OF THE INVENTION

In one embodiment, a receptacle assembly is provided having a front housing having a mating end and a loading end. A contact module is coupled to the loading end of the front housing. The contact module includes a frame assembly that includes a plurality of contacts and a dielectric frame that support the contacts. The dielectric frame has first and second sides. The dielectric frame has channels between the contacts that extend at least partially through the dielectric frame between the first and second sides. The contacts extend from the dielectric frame for electrical termination. Ground conductors are received in corresponding channels and provide electrical shielding between corresponding contacts. A ground shield is coupled to the first side. The ground shield has side shields that extend along sides of the contacts to provide electrical shielding along sides of the contacts. The ground shield has shield tabs that engage corresponding ground conductors to electrically connect the ground shield to the ground conductors.

In another embodiment, a receptacle assembly is provided having a front housing having a mating end and a loading end. A contact module is coupled to the loading end of the front housing. The contact module includes a frame assembly including a plurality of contacts. The frame assembly includes a first dielectric frame that supports at least some of the contacts and a second dielectric frame that supports at least some of the contacts. The first and second dielectric frames each have opposite inner and outer sides. The inner sides face one another. The first and second dielectric frames each have channels located between corresponding contacts. The channels extend at least partially through the first and second dielectric frames between the inner and outer sides. The contacts extend from the first and second dielectric frames for electrical termination. First ground conductors are received in corresponding channels of the first dielectric frame and provide electrical shielding between corresponding contacts supported by the first dielectric frame. Second ground conductors are received in corresponding channels of the second dielectric frame and provide electrical shielding between corresponding contacts supported by the second dielectric frame. A first ground shield is coupled to the outer side of the first dielectric frame. The first ground shield has side shields that extend along sides of the contacts of the first dielectric frame to provide electrical shielding along sides of such contacts. The first ground shield has shield tabs that engage corresponding first ground conductors to electrically connect the first ground shield to the first ground conductors. A second ground shield is coupled to the outer side of the second dielectric frame. The second ground shield has side shields that extend along sides of the contacts of the second dielectric frame to provide electrical shielding along sides of such contacts. The second ground shield has shield tabs that engage corresponding second ground conductors to electrically connect the second ground shield to the second ground conductors.

In a further embodiment, a contact module for a receptacle assembly is provided having a pair of dielectric frames that surround and hold signal contacts. The signal contacts are arranged in pairs carrying differential signals. One contact in each pair is held by one of the dielectric frames and the other contact in each pair is held by the other dielectric frame. Ground conductors are held by the dielectric frames. The ground conductors are positioned between the pairs of contacts. A ground shield is coupled to an exterior surface of one of the dielectric frames. The ground shield is separate and discrete from the ground conductors. The ground shield engages corresponding ground conductors to electrically connect the ground shield to the ground conductors.

DETAILED DESCRIPTION OF THE INVENTION

Figure 1:
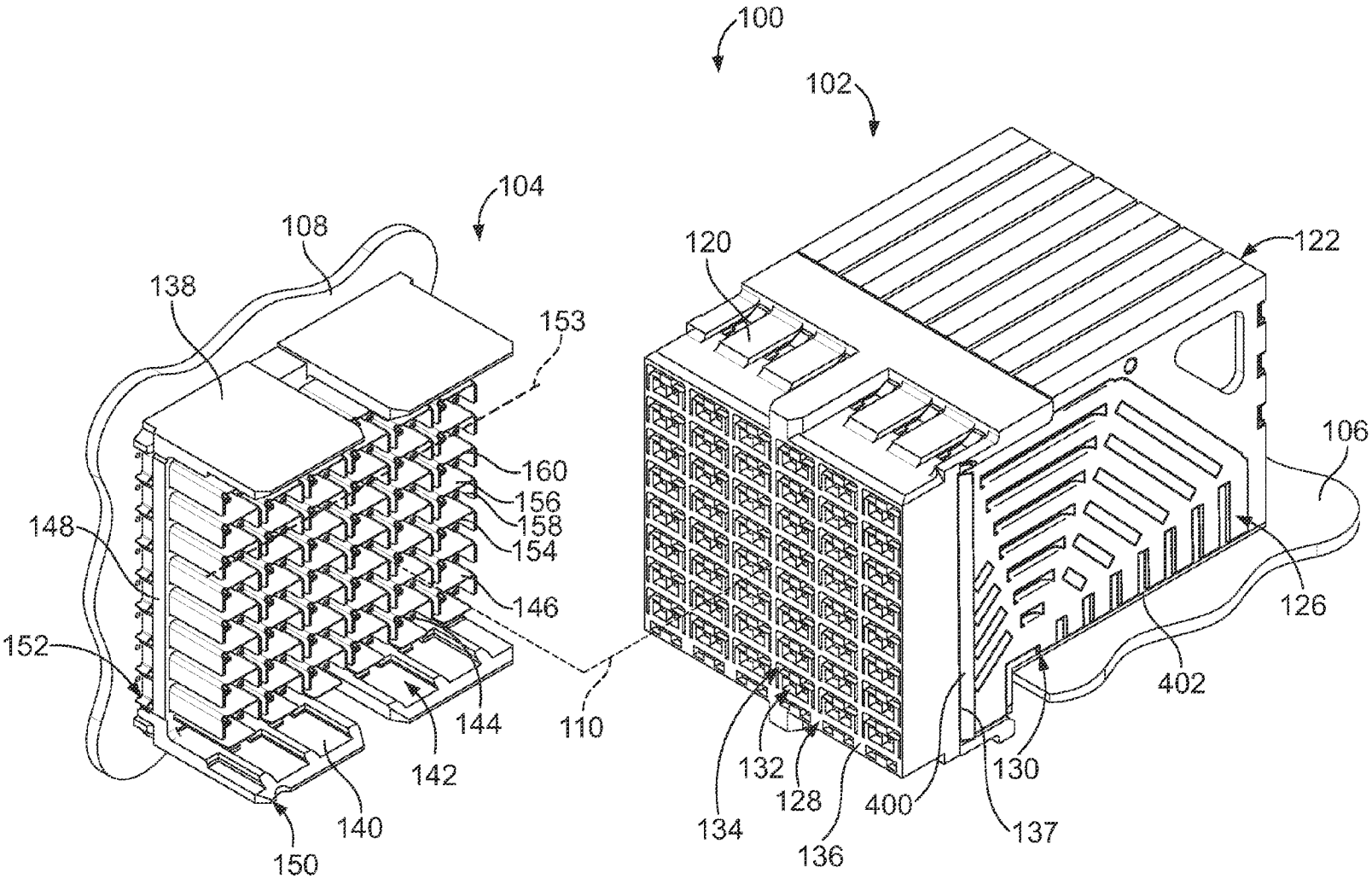
FIG. 1 is a perspective view of an exemplary embodiment of an electrical connector system illustrating a receptacle assembly and a header assembly.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a front housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) that are received in the front housing 120 for mating with the header assembly 104. In an exemplary embodiment, each contact module 122 has a shield structure 126 for providing electrical shielding for the receptacle signal contacts 124. In an exemplary embodiment, the shield structure 126 is electrically connected to the header assembly 104 and/or the circuit board 106. For example, the shield structure 126 may be electrically connected to the header assembly 104 by a ground leadframe 204, 206 (shown in FIG. 2) held by the contact modules 122 and a mating gasket 400 that engages the header assembly 104. The shield structure 126 may be electrically connected to the circuit board 106 by the ground leadframe 204, 206 and a circuit board gasket 402. The mating gasket 400 is used to create a ground path between the shield structure 126 and the header assembly 104. The circuit board gasket 402 is used to create a ground path between the shield structure 126 and the circuit board 106. The gaskets 400, 402 are conductive and define ground interfaces. Other types of conductive paths other than the gaskets 400, 402 may be used in alternative embodiments, such as fingers, pins, beams and the like that extend from the contact modules 122 to directly engage the header shields 146 and/or the circuit board 106.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. The receptacle signal contacts 124 within a column are all part of the same contact module 122. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The front housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header shields 146 therein when the receptacle and header assemblies 102, 104 are mated. The header shields 146 are configured to engage the mating gasket 400 to electrically connect the grounded components of the header assembly 104 to the shield structure 126 of the receptacle assembly 102. The mating gasket 400 electrically commons the receptacle and header assemblies 102, 104.

The front housing 120 is manufactured from a dielectric material, such as a plastic material, and provides isolation between the signal contact openings 132 and the ground contact openings 134. The front housing 120 isolates the receptacle signal contacts 124 and the header signal contacts 144 from the header shields 146. The front housing 120 isolates each set of receptacle and header signal contacts 124, 144 from other sets of receptacle and header signal contacts 124, 144. The front housing 120 extends between a mating end 136 and a loading end 137. The contact modules 122 are loaded into the housing 120 through and/or coupled to the loading end 137.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header shields 146 extend from a base wall 148 into the chamber 142. The header signal contacts 144 and the header shields 146 extend through the base wall 148 and are mounted to the circuit board 108.

In an exemplary embodiment, the header signal contacts 144 are arranged as differential pairs. The header signal contacts 144 are arranged in rows along row axes 153. The header shields 146 are positioned between the differential pairs to provide electrical shielding between adjacent differential pairs. In the illustrated embodiment, the header shields 146 are C-shaped and provide shielding on three sides of the pair of header signal contacts 144. The header shields 146 have a plurality of walls, such as three planar walls 154, 156, 158. The walls 154, 156, 158 may be integrally formed or alternatively, may be separate pieces. The wall 156 defines a center wall or top wall of the header shields 146. The walls 154, 158 define side walls that extend from the center wall 156. The header shields 146 have a front edge 160. The front edge is configured to engage the mating gasket 400 when the receptacle and header assemblies 102, 104 are mated. The header shield 146 associated with another pair of header signal contacts 144 provides shielding along the open, fourth side thereof such that each of the pairs of signal contacts 144 is shielded from each adjacent pair in the same column and the same row. For example, the top wall 156 of a first header shield 146 which is below a second header shield 146 provides shielding across the open bottom of the C-shaped second header shield 146. Other configurations or shapes for the header shields 146 are possible in alternative embodiments. More or less walls may be provided in alternative embodiments. The walls may be bent or angled rather than being planar. In other alternative embodiments, the header shields 146 may provide shielding for individual signal contacts 144 or sets of contacts having more than two signal contacts 144.

Figure 2:
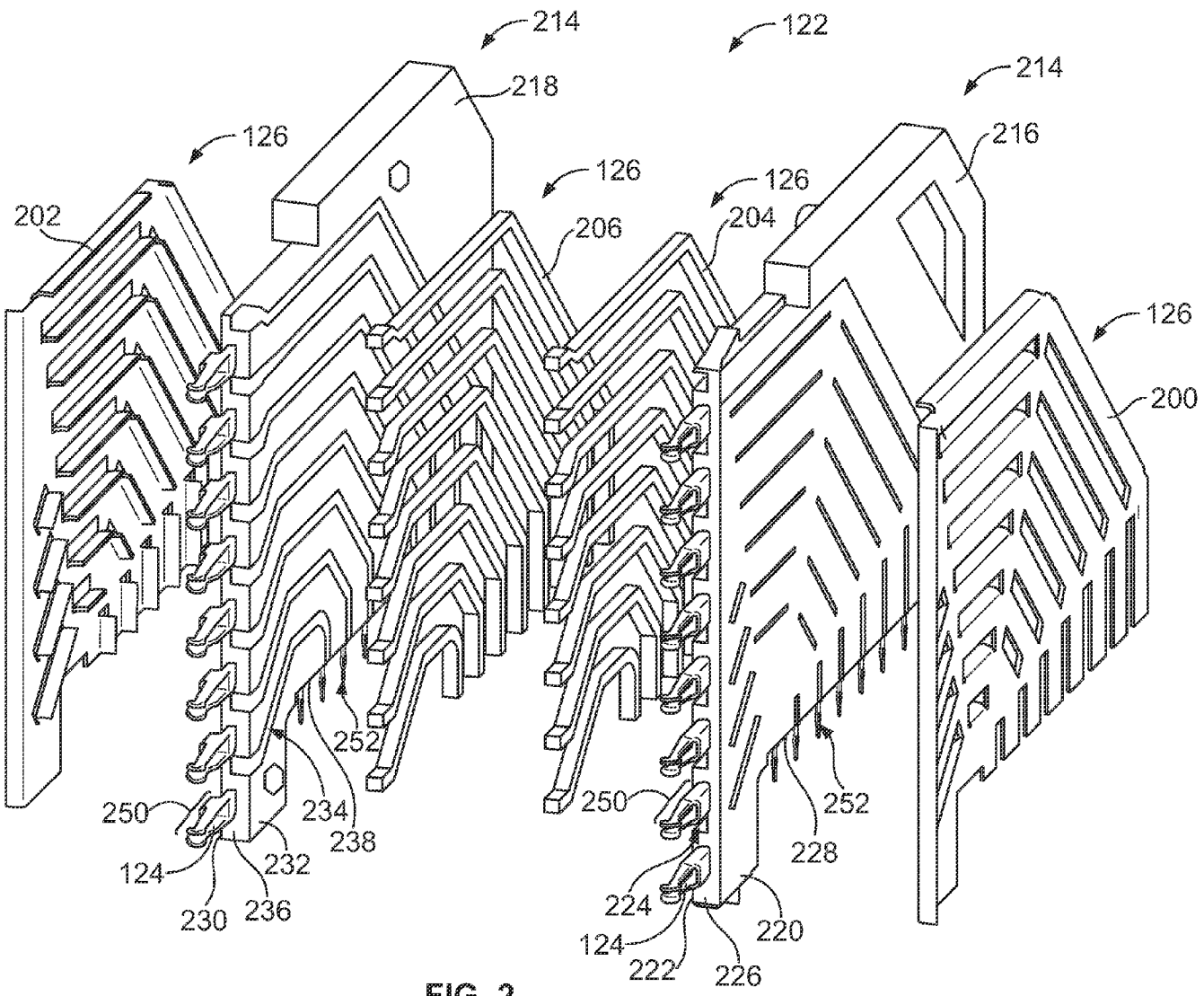
FIG. 2 is an exploded view of one of the contact modules and part of a shield structure shown in FIG. 1.

FIG. 2 is an exploded view of one of the contact modules 122 and part of the shield structure 126. The shield structure 126 includes a first ground shield 200 and a second ground shield 202. The shield structure 126 includes first and second ground leadframes 204, 206 electrically connected to one another and the first and second ground shields 200, 202, respectively. The shield structure 126 includes the mating gasket 400 and the circuit board gasket 402 (both shown in FIG. 1). The ground shields 200, 202 and ground leadframes 204, 206 are electrically connected to the header and circuit board gaskets 400, 402. The ground shields 200, 202 and ground leadframes 204, 206 provide multiple, redundant points of contact to the header and circuit board gaskets 400, 402. The ground shields 200, 202 and ground leadframes 204, 206 provide shielding on all sides of the receptacle signal contacts 124.

The contact module 122 includes a frame assembly 214 having a first dielectric frame 216 and a second dielectric frame 218 that are coupled together to form the contact module 122. The frame assembly 214 includes the receptacle signal contacts 124. The dielectric frames 216, 218 are fabricated from a dielectric material and surround the receptacle signal contacts 124. For example, the dielectric frames 216, 218 may be a molded plastic material overmolded over the receptacle signal contacts 124. In an exemplary embodiment, the receptacle signal contacts 124 are initially held together as signal leadframes (not shown), which are overmolded with dielectric material to form the dielectric frames 216, 218. Other manufacturing processes may be utilized to form the contact modules 122 other than overmolding a leadframe, such as loading receptacle signal contacts 124 into a formed dielectric body.

The first dielectric frame 216 extends between a first, or exterior, side 220 and a second, or interior, side 222. The first ground shield 200 is configured to be coupled to the first, or exterior, side 220. The first dielectric frame 216 includes a plurality of channels 224 formed in the interior side 222. The first ground leadframe 204 is configured to be coupled to the interior side 222 by being loaded into the channels 224. The first dielectric frame 216 includes a front wall 226 and a bottom wall 228.

The second dielectric frame 218 extends between a first, or exterior, side 230 and a second, or interior, side 232. The second ground shield 202 is configured to be coupled to the first, or exterior, side 230. The second dielectric frame 218 includes a plurality of channels 234 formed in the interior side 232. The second ground leadframe 206 is configured to be coupled to the interior side 232 by being loaded into the channels 234. The second dielectric frame 218 includes a front wall 236 and a bottom wall 238.

The receptacle signal contacts 124 have mating portions 250 extending from the front walls 226, 236 and contact tails 252 extending from the bottom walls 228, 238. Other configurations are possible in alternative embodiments. The mating portions 250 and contact tails 252 are the portions of the receptacle signal contacts 124 that extend from the dielectric frames 216, 218. In an exemplary embodiment, the mating portions 250 extend generally perpendicular with respect to the contact tails 252. Inner portions or encased portions of the receptacle signal contacts 124 transition between the mating portions 250 and the contact tails 252 within the dielectric frames 216, 218. When the contact module 122 is assembled, the mating portions 250 are configured to be mated with the header signal contacts 144 (shown in FIG. 1) and the contact tails 252 are configured to be mated with the circuit board 106.

The shield structure 126 provides electrical shielding between and around respective receptacle signal contacts 124. The shield structure 126 provides shielding from electromagnetic interference (EMI) and/or radio frequency interference (RFI). The shield structure 126 may provide shielding from other types of interference as well. The shield structure 126 provides external shielding around the outside of the dielectric frames 216, 218, and thus around the outside of each of the receptacle signal contacts 124, such as between pairs of receptacle signal contacts 124. The shield structure 126 provides internal shielding within the interior of the contact module, such as between receptacle signal contacts 124, using the ground leadframes 204, 206. The internal and external shielding controls electrical characteristics, such as impedance control, cross-talk control, and the like, of the receptacle signal contacts 124.

Figure 3:
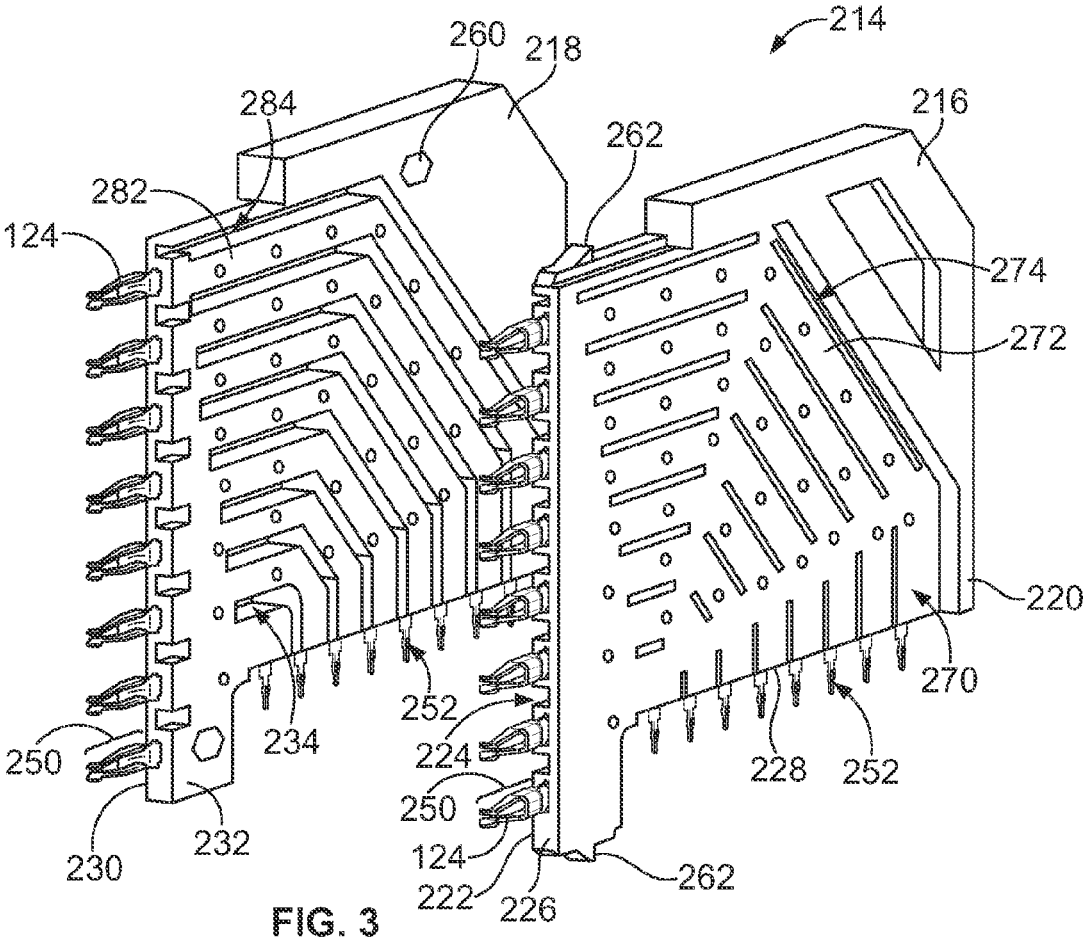
FIG. 3 is a side perspective view of a frame assembly for the contact module shown in FIG. 2.

FIG. 3 is a side perspective view of the frame assembly 214 showing the first and second dielectric frames 216, 218. In an exemplary embodiment, the first and second dielectric frames 216, 218 are substantially similar to one another. For example, the first and second dielectric frames 216, 218 are generally mirrored halves of the frame assembly 214, however the first and second dielectric frames 216, 218 may include different features 260 to secure the first and second dielectric frames 216, 218 together, such as posts on one and openings on the other, or different retention features 262 for securing the contact module 122 to the front housing 120 (shown in FIG. 1).

The first dielectric frame 216 includes a pocket 270 on the exterior side 220 that receives the first ground shield 200 (shown in FIG. 2). The pocket 270 is provided exterior of some or all of the channels 224. The channels 224 extend at least partially through the first dielectric frame 216 between the interior side 222 and the exterior side 220. In the illustrated embodiment, the channels 224 extend at least half way between the interior side 222 and the exterior side 220. The channels 224 are located between, and may define, frame members 272 of the first dielectric frame 216.

The frame members 272 are the portions of the first dielectric frame 216 that surround the receptacle signal contacts 124. In the illustrated embodiment, the frame members 272 transition between the front wall 226 and the bottom wall 228. The mating portions 250 extend from corresponding frame members 272 and the contact tails 252 extend from corresponding frame members 272. The frame members 272 encase the receptacle signal contacts 124. The frame members 272 may be overmolded around the receptacle signal contacts 124. Having the channels 224 between the frame members 272 positions the channels 224 between the receptacle signal contacts 124. The receptacle signal contacts 124 are separated from each other by corresponding channels 224. In an exemplary embodiment, the receptacle signal contacts 124 are held by the first dielectric frame 216 along a contact plane defined approximately centered between, and generally parallel to, the exterior side 220 and the interior side 222. The channels 224 extend into the first dielectric frame 216 from the interior side 222 at least as far as the contact plane such that the ground leadframe 204 (shown in FIG. 2) at least partially lies in the contact plane and provides shielding between the receptacle signal contacts 124 in the contact plane.

The first dielectric frame 216 includes a plurality of slots 274 extending therethrough between the frame members 272. The slots 274 extend between the exterior side 220 and the channels 224. The slots 274 extend entirely through the first dielectric frame 216 to the corresponding channels 224. The slots 274 are located between adjacent receptacle signal contacts 124. The slots 274 extend along lengths of the receptacle signal contacts 124 between the contact tails 252 and the mating portions 250. Optionally, the slots 274 may extend along a majority of the length of each receptacle signal contact 124 measured between the corresponding contact tail 252 and mating portion 250. The slots 274 provide an opening or window to allow the ground shield 200 to extend through the first dielectric frame 216 to engage the first ground leadframe 204 to electrically common the first ground shield 200 and the first ground leadframe 204.

The second dielectric frame 218 includes a pocket (not shown) on the exterior side 230 that receives the second ground shield 202 (shown in FIG. 2). The pocket may be similar to the pocket 270. The channels 234 extend at least partially through the second dielectric frame 218 between the interior side 232 and the exterior side 230. In the illustrated embodiment, the channels 234 extend at least half way between the interior side 232 and the exterior side 230. The channels 234 are located between, and may define, frame members 282 of the second dielectric frame 218.

The frame members 282 are the portions of the second dielectric frame 218 that surround the receptacle signal contacts 124. The frame members 282 encase the receptacle signal contacts 124. The receptacle signal contacts 124 are separated from each other by corresponding channels 234. In an exemplary embodiment, the receptacle signal contacts 124 are held by the second dielectric frame 218 along a contact plane defined approximately centered between, and generally parallel to, the exterior side 230 and the interior side 232. The channels 234 extend into the second dielectric frame 218 from the interior side 232 at least as far as the contact plane such that the second ground leadframe 206 (shown in FIG. 2) at least partially lies in the contact plane and provides shielding between the receptacle signal contacts 124 in the contact plane.

The second dielectric frame 218 includes a plurality of slots 284 extending therethrough between the frame members 282. The slots 284 extend between the exterior side 230 and the channels 234. The slots 284 provide an opening or window to allow the second ground shield 202 to extend through the second dielectric frame 218 to engage the second ground leadframe 206 to electrically common the second ground shield 202 and the second ground leadframe 206.

Figure 4:
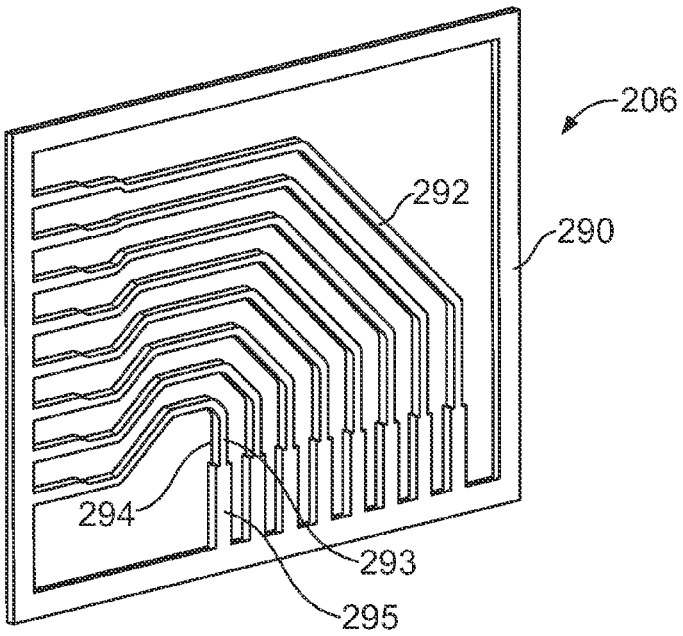
FIG. 4 illustrates a ground leadframe for the contact module shown in FIG. 2.

FIG. 4 illustrates the ground leadframe 206 held by a carrier 290. The ground leadframe 206 may be substantially similar to the ground leadframe 204 (shown in FIG. 2), and like components of the ground leadframe 204 may be identified with like reference numerals. The ground leadframe 206 includes a plurality of ground conductors 292 extending between sides of the carrier 290. The ground conductors 292 are the portions of the ground leadframe 206 that are received in and held by the second dielectric frame 218 (shown in FIG. 3). The ground conductors 292 have opposite sides 293, 294. When assembled, the sides 293 may define interior sides and the sides 294 may define exterior sides.

Extensions 295 extend between the ground conductors 292 and the carrier 290. The extensions 295 are removed during a later manufacturing process to separate the ground conductors 292 from the carrier 290. In an exemplary embodiment, the ground conductors 292, extensions 295 and carrier 290 are stamped from a metal workpiece.

In an exemplary embodiment, during assembly, the ground leadframe 206, including the carrier 290, is coupled to the second dielectric frame 218 such that each ground conductor 292 is received in a corresponding channel 234 (shown in FIG. 3). The carrier 290 is then removed by cutting or otherwise separating the ground conductors 292 from the extensions 295.

Figure 5:
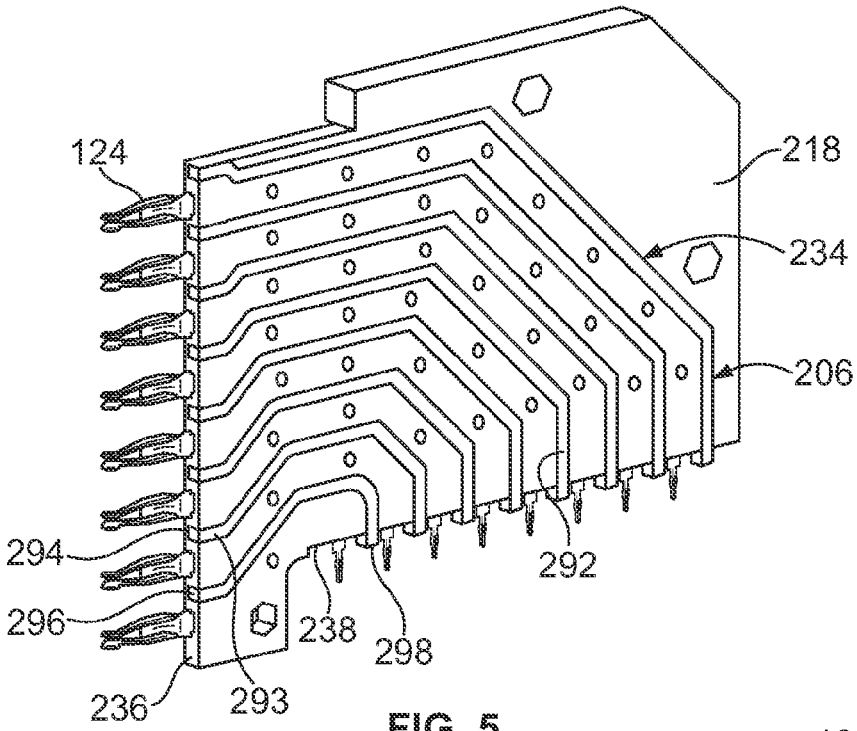
FIG. 5 illustrates the ground leadframe shown in FIG. 4 loaded into a portion of the frame assembly shown in FIG. 3.

FIG. 5 illustrates the ground leadframe 206 in the second dielectric frame 218. The ground conductors 292 extend between adjacent receptacle signal contacts 124. The ground conductors 292 and the receptacle signal contacts 124 are arranged in an alternating sequence of ground-signal-ground-signal (G-S-G-S) through the dielectric frame 218. The ground conductors 292 provide shielding between adjacent receptacle signal contacts 124. The ground conductors 292 at least partially lie in the contact plane defined by the receptacle signal contacts 124. The interior sides 293 face inward and are exposed for engaging the ground conductors of the first ground leadframe 204 (shown in FIG. 2). The exterior sides 294 face outward and engage the bottom of the channels 234. The exterior sides 294 are exposed in the slots 284 (shown in FIG. 3) and are configured to be engaged by the second ground shield 202 (shown in FIG. 2).

The ground conductors 292 extend between mating ends 296 and mounting ends 298. The mating ends 296 are arranged at the front wall 236 of the second dielectric frame 218 for termination to the mating gasket 400 (shown in FIG. 1). The mounting ends 298 are arranged at the bottom wall 238 of the second dielectric frame 218 for termination to the circuit board gasket 402. In the illustrated embodiment, the mating and mounting ends 296, 298 are flat ends that are configured to abut the gaskets 400, 402 to make electrical contact with the gaskets 400, 402. The mating and mounting ends 296, 298 may have different shapes and may be terminated by different means in alternative embodiments. For example, rather than having flat ends that are configured to engage the gasket 400, the mating ends 296 may have beams or fingers that are configured to directly engage the header shields 146 (shown in FIG. 1). For example, rather than having flat ends that are configured to engage the gasket 402, the mounting ends 298 may have compliant pins that are configured to directly engage the circuit board 106.

Figure 6:
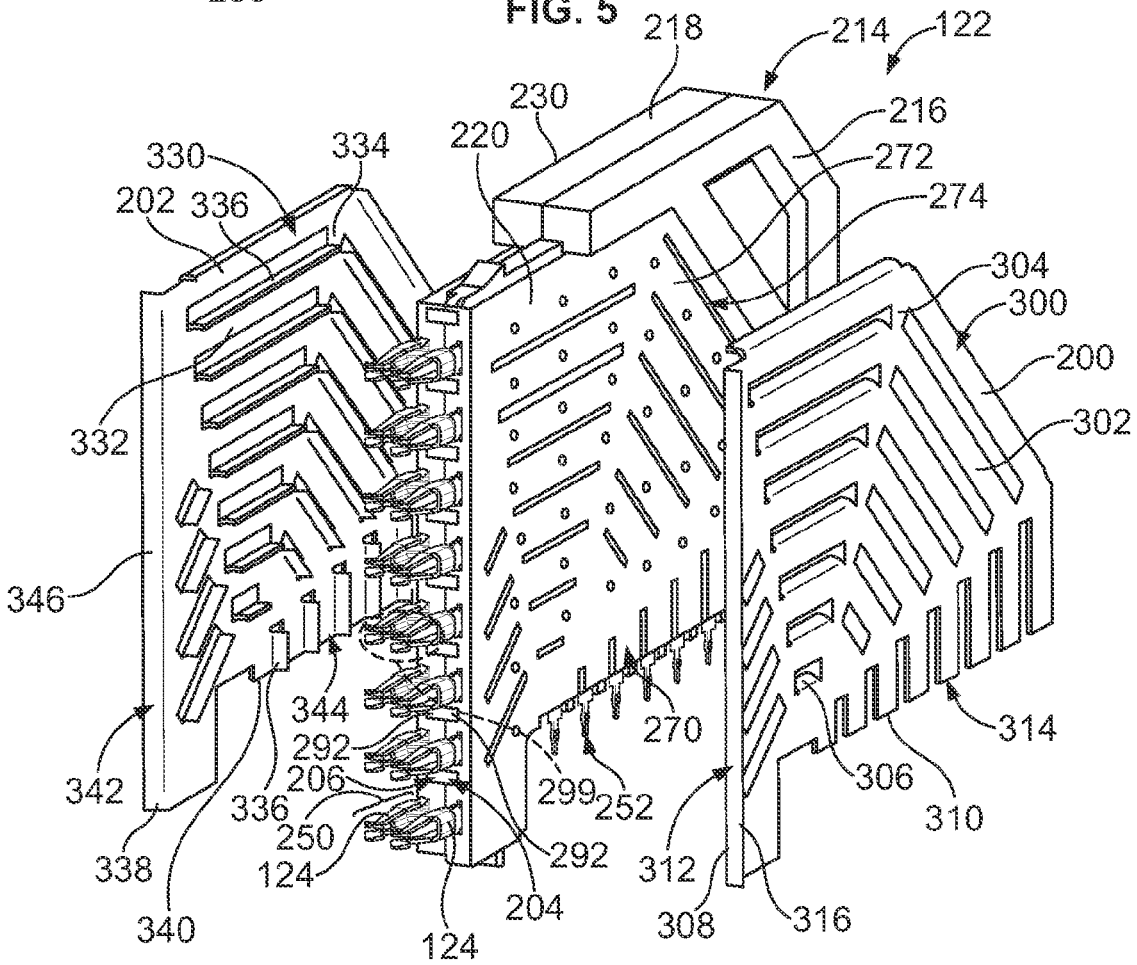
FIG. 6 is a partially assembled view of the contact module.

FIG. 6 is a partially assembled view of the contact module 122 showing the ground shields 200, 202 poised for mating to the frame assembly 214. When assembled, the dielectric frames 216, 218 are aligned adjacent one another such that the receptacle signal contacts 124 are aligned with one another and define contact pairs 299. Each contact pair 299 is configured to transmit differential signals through the contact module 122. When assembled, the ground leadframes 204, 206 are loaded into the dielectric frames 216, 218. The ground leadframes 204, 206 engage one another to electrically common the ground leadframes 204, 206. The ground leadframes 204, 206 provide internal shielding between corresponding receptacle signal contacts 124. The ground leadframes 204, 206 transition with the receptacle signal contacts 124 between the front and the bottom of the contact module 122.

The first ground shield 200 includes a main body 300. In the illustrated embodiment, the main body 300 is generally planar. The ground shield 200 includes a plurality of side shields 302 coupled together by web portions 304 and defining the main body 300. The ground shield 200 includes a plurality of shield tabs 306 extending from the side shields 302. In an exemplary embodiment, the shield tabs 306 extend generally perpendicular to the side shields 302. The shield tabs 306 and the side shields 302 may be integrally formed, such as by being stamped and formed from a common workpiece.

The first ground shield 200 includes a front 308 and a bottom 310. In the illustrated embodiment, the front 308 and bottom 310 are generally perpendicular to one another, however other configurations are possible in alternative embodiments. The first ground shield 200 includes one or more mating ends 312 and one or more mounting ends 314. Optionally, the mounting ends 314 are defined by bottom edges of the ground shield 200. The mating end(s) 312 is configured to engage the mating gasket 400 (shown in FIG. 1) and the mounting end(s) 314 is configured to engage the circuit board gasket 402 (shown in FIG. 1). In an alternative embodiment, rather than mating to the gaskets 400 and/or 402, the ground shield 200 may include spring fingers or beams that are configured to directly engage the header shields 146 (shown in FIG. 1). In the illustrated embodiment, the first ground shield 200 includes a flange 316 at the front 308 defining the mating end 312. The flange 316 extends generally perpendicular to the main body 300. In the illustrated embodiment, the side shields 302 at the bottom 310 have flat ends that define the mounting ends 314. In an alternative embodiment, the side shields 302 may include flanges to increase the surface area of the mounting ends 314 for termination to the circuit board gasket 402, or alternatively, a single flange may be provided at the mounting end 314, similar to the flange 316.

During assembly, the ground shield 200 is coupled to the exterior side 220 of the first dielectric frame 216. The ground shield 200 may be received in the pocket 270. The shield tabs 306 extend into corresponding slots 274 to engage the ground conductors of the first ground leadframe 204. The shield tabs 306 may be biased against the ground conductors of the first ground leadframe 204 to ensure electrical connection therebetween. The side shields 302 extend along sides of the receptacle signal contacts 124 to provide shielding along the sides of the receptacle signal contacts 124. The side shields 302 are aligned with, and exterior of, the receptacle signal contacts 124 as the receptacle signal contacts transition between the mating portions 250 and the contact tails 252. The side shields 302 are aligned with the frame members 272 and are positioned between the slots 274. The side shields 302 of the ground shield 200 provide shielding along a shield plane that is parallel to, and positioned exterior of, the contact plane defined by the receptacle signal contacts 124 held by the first dielectric frame 216.

The second ground shield 202 includes a main body 330. In the illustrated embodiment, the main body 330 is generally planar. The ground shield 202 includes a plurality of side shields 332 coupled together by web portions 334 and defining the main body 330. The ground shield 202 includes a plurality of shield tabs 336 extending from the side shields 332. In an exemplary embodiment, the shield tabs 336 extend generally perpendicular to the side shields 332. The shield tabs 336 and the side shields 332 may be integrally formed, such as by being stamped and formed from a common workpiece.

The second ground shield 202 includes a front 338 and a bottom 340. In the illustrated embodiment, the front 338 and bottom 340 are generally perpendicular to one another, however other configurations are possible in alternative embodiments. The second ground shield 202 includes one or more mating ends 342 and one or more mounting ends 344. Optionally, the mounting ends 344 are defined by bottom edges of the ground shield 202. The mating end(s) 342 is configured to engage the mating gasket 400 (shown in FIG. 1) and the mounting end(s) 344 is configured to engage the circuit board gasket 402 (shown in FIG. 1). In an alternative embodiment, rather than mating to the gaskets 400 and/or 402, the ground shield 202 may include spring fingers or beams that are configured to directly engage the header shields 146 (shown in FIG. 1). In the illustrated embodiment, the second ground shield 202 includes a flange 346 at the front 338 defining the mating end 342. The flange 346 extends generally perpendicular to the main body 330. In the illustrated embodiment, the side shields 332 at the bottom 340 have flat ends that define the mounting ends 344. In an alternative embodiment, the side shields 332 may include flanges to increase the surface area of the mounting ends 344 for termination to the circuit board gasket 402, or alternatively, a single flange may be provided at the mounting end 344, similar to the flange 346.

During assembly, the ground shield 202 is coupled to the exterior side 230 of the second dielectric frame 218. The ground shield 202 may be received in the pocket (not shown) at the exterior side 230. The shield tabs 336 extend into corresponding slots 284 (shown in FIG. 3) to engage the ground conductors 292 (shown in FIG. 5) of the second ground leadframe 206. The shield tabs 336 may be biased against the ground conductors of the second ground leadframe 206 to ensure electrical connection therebetween. The side shields 332 extend along sides of the receptacle signal contacts 124 to provide shielding along the sides of the receptacle signal contacts 124. The side shields 332 are aligned with, and exterior of, the receptacle signal contacts 124 as the receptacle signal contacts transition between the mating portions 250 and the contact tails 252. The side shields 332 are aligned with the frame members 282 and are positioned between the slots 284. The side shields 332 of the ground shield 202 provide shielding along a shield plane that is parallel to, and positioned exterior of, the contact plane defined by the receptacle signal contacts 124 held by the second dielectric frame 218.

Figure 7:
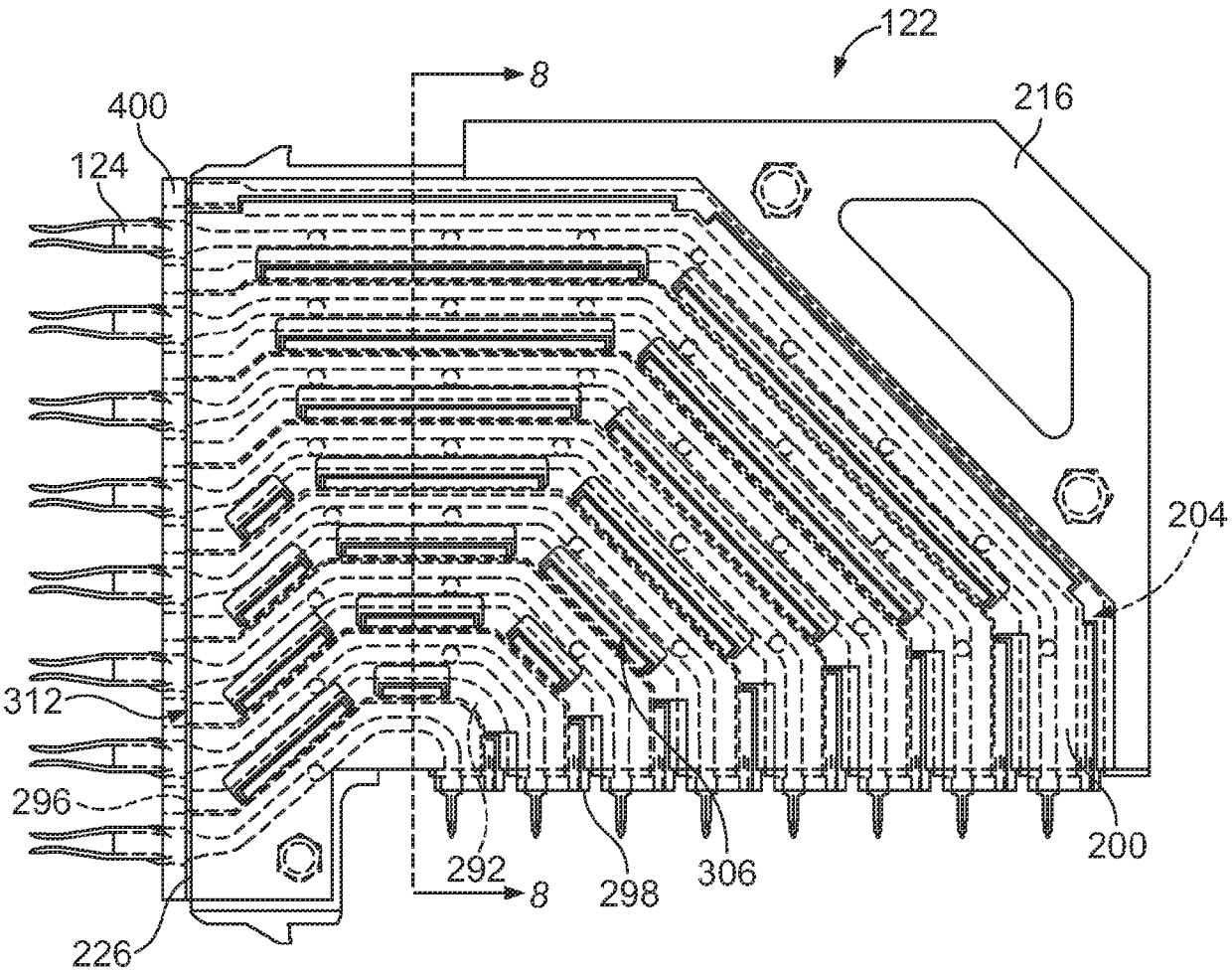
FIG. 7 is a side view of the contact module.

FIG. 7 is a side view of the contact module 122. The receptacle signal contacts 124 and the ground conductors 292 of the first ground leadframe 204 are illustrated in phantom. The ground conductors 292 are provided between corresponding receptacle signal contacts 124 to provide shielding between the pairs 299 (shown in FIG. 6) of receptacle signal contacts 124.

The shield tabs 306 extend into the dielectric frame 216 to engage corresponding ground conductors 292. In an exemplary embodiment, the shield tabs 306 engage the ground conductors 292 along a majority of a length of the ground conductors 292 between the mating and mounting ends 296, 298. In an exemplary embodiment, the mating ends 296 of the ground conductors 292 are generally flush with the front wall 226 and engage the mating gasket 400. The mating end 312 of the ground shield 200 is generally flush with the front wall 226 and engages the mating gasket 400.

Figure 8:
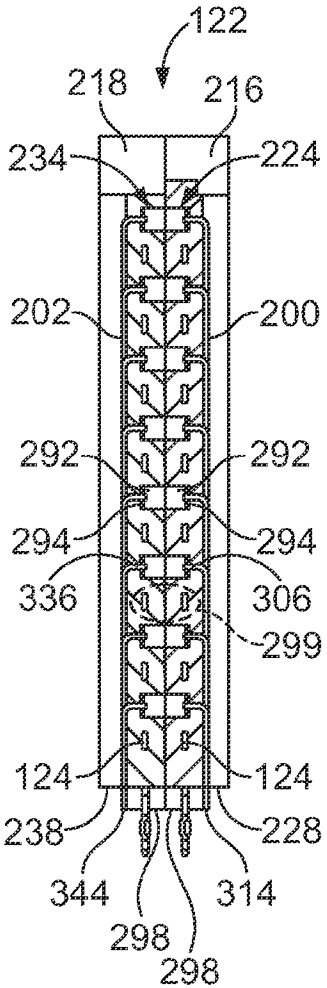
FIG. 8 is a cross-sectional view of the contact module taken along line 8-8 shown in FIG. 7.

FIG. 8 is a cross-sectional view of the contact module 122 taken along line 8-8 shown in FIG. 7. The ground conductors 292 of both dielectric frames 216, 218 are provided between corresponding receptacle signal contacts 124 to provide shielding between the pairs 299 of receptacle signal contacts 124. The ground conductors 292 extend into the channels 224, 234 such that the ground conductors are directly in line between the receptacle signal contacts 124. The ground conductors 292 extend into the dielectric frames 216, 218 at least as far as the contact planes of the receptacle signal contacts 124.

The shield tabs 306, 336 extend into the dielectric frames 216, 218, respectively, to engage corresponding ground conductors 292. In an exemplary embodiment, the shield tabs 306, 336 are biased against the exterior sides 294 of the ground conductors 292 to ensure an electrical connection between the shield tabs 306, 336 and the ground conductors 292. In an exemplary embodiment, the mounting ends 298 of the ground conductors 292 extend slightly past the bottom walls 228, 238 of the dielectric frames 216, 218 and are configured to engage the circuit board gasket 402 (shown in FIG. 10). The mounting ends 314, 344 of the ground shields 200, 202 extend slightly past the bottom walls 228, 238 and are configured to engage the circuit board gasket 402.

Figure 9:
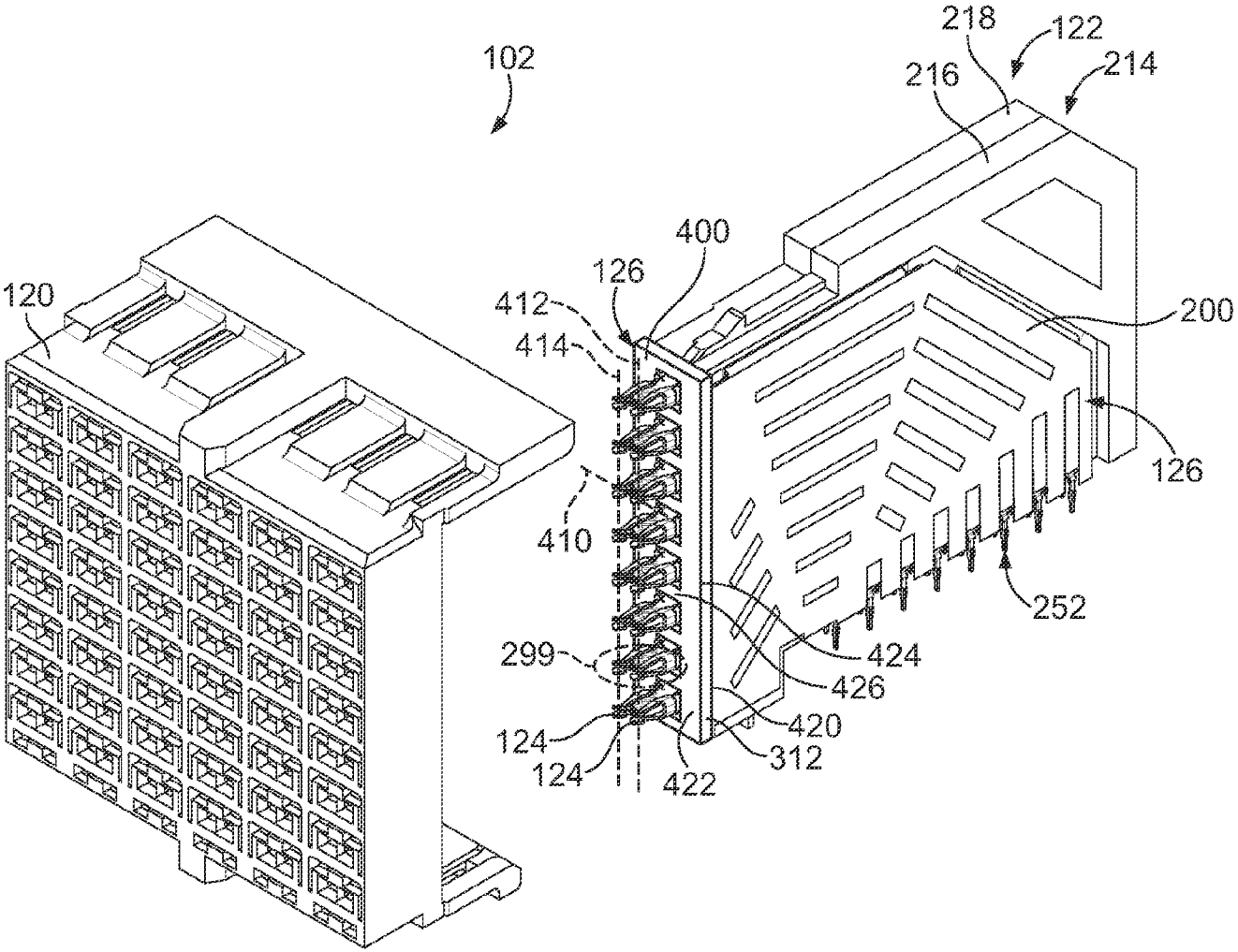
FIG. 9 is an exploded view of a portion of the receptacle assembly.

FIG. 9 is an exploded view of the receptacle assembly 102 showing one of the contact modules 122 poised for loading into the front housing 120. Only one contact module 122 is illustrated in FIG. 9, and it is realized that any number of contact modules 122 may be loaded into the front housing 120 during assembly of the receptacle assembly 102. FIG. 9 also illustrates one mating gasket 400 coupled to the front of the contact module 122. Each contact module 122 loaded into the front housing 120 may include a separate mating gasket 400, or alternatively, a single mating gasket may be coupled to all of the contact modules 122 prior to loading the contact modules 122 into the front housing 120. In other alternative embodiments, one or more mating gaskets 400 may be coupled to the front housing 120 prior to loading the contact modules 122 into the front housing 120. The mating gasket(s) 400 is configured to be positioned between the front of the contact module 122 and the front housing 120.

During assembly of the contact module 122, the ground leadframes 204, 206 (shown in FIG. 2) are loaded into the dielectric frames 216, 218. The dielectric frames 216, 218 are coupled together and generally surround the receptacle signal contacts 124. The dielectric frames 216, 218 are aligned adjacent one another such that the receptacle signal contacts 124 are aligned with one another and define the contact pairs 299. The first and second ground shields 200, 202 (shown in FIG. 6) are coupled to the frame assembly 214 to provide shielding for the receptacle signal contacts 124.

Figure 10:
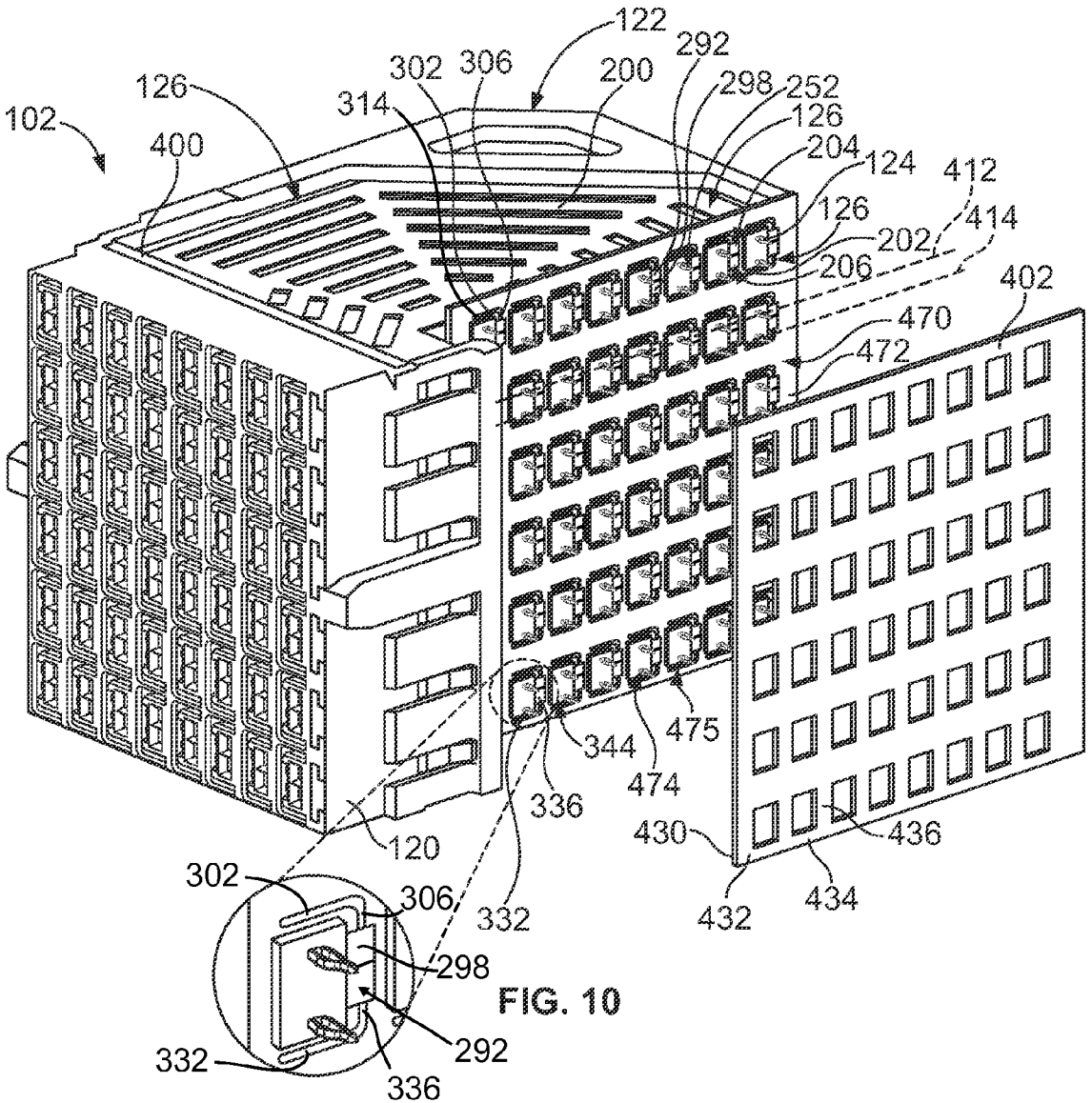
FIG. 10 is an exploded view of the receptacle assembly.

The receptacle signal contacts 124 within each contact pair 299 are arranged in rows that extend along row axes 410. The receptacle signal contacts 124 within the dielectric frame 216 are arranged within a column along a column axis 412. Similarly, the receptacle signal contacts 124 of the dielectric frame 218 are arranged in a column along a column axis 414. In the illustrated embodiment, at the mating end, the rows are oriented horizontally and the columns are oriented vertically, however it is noted that at the contact tails 252, the columns, and thus the column axes 412, 414, as shown in FIG. 10, are oriented horizontally. Other orientations are possible in alternative embodiments.

The mating gasket 400 includes a first mounting surface 420 that is configured to be mounted to, and engage, the shield structure 126. The mating gasket 400 includes a second mounting surface 422 opposite the first mounting surface 420 that is engaged by the edges 160 (shown in FIG. 1) of the header shields 146 (shown in FIG. 1). The mating gasket 400 is conductive and defines a ground path therethrough. As such, the shield structure 126 is electrically grounded to the header shields 146 through the conductive mating gasket 400.

The mating gasket 400 includes longitudinal strips 424 and lateral strips 426 extending between the longitudinal strips 424. The ground shields 200, 202 are configured to engage the longitudinal strips 424. For example, the flanges 316, 346 (shown in FIG. 6) defining the mating ends 312, 342 (shown in FIG. 6) of the ground shields 200, 202 engage the longitudinal strips 424. The mating ends 296 (shown in FIG. 5) of the ground conductors 292 (shown in FIG. 5) engage the lateral strips 426.

In an exemplary embodiment, the mating gasket 400 includes an elastomeric sheet that is compressible to define a compressible interface between the shield structure 126 and the header shields 146. The elastomeric sheet is conductive to define a conductive pathway between the first and second mounting surfaces 420, 422. For example, the mating gasket 400 may be fabricated from a compliant plastic or rubber material having conductive filler, a conductive plating, a conductive coating and the like. Alternatively, the mating gasket 400 may be fabricated from a conductive fabric, such as a woven mesh. In other alternative embodiments, the mating gasket 400 may be fabricated from a metallic plate, metallic strips, or a metallic mold or die. In such embodiments, the mating gasket 400 may include compressible elements, such as spring fingers, to ensure contact between the mating gasket 400 and the shield structure 126 and/or the header shields 146.

FIG. 10 is an exploded view of the receptacle assembly 102 showing the circuit board gasket 402 poised for loading onto the contact modules 122. FIG. 10 also illustrates a contact spacer 470 coupled to the bottoms of the contact modules 122. The contact spacer 470 is used to organize and/or hold the contact tails 252 for mounting to the circuit board 106 (shown in FIG. 1).

The contact spacer 470 includes a base 472 having a plurality of openings 474, 475 therethrough. The base 472 is manufactured from a dielectric material. The openings 474 are configured to receive corresponding contact tails 252. The openings 475 are configured to receive the mounting ends 298 of the ground conductors 292 and the mounting ends 314, 344 of the ground shields 200, 202. The openings 474 are arranged in rows and columns that correspond to the positioning of the contact tails 252. The openings 475 tend to surround (e.g. forward, rearward, and both sides) the openings 474 for the contact tails 252. The mounting ends 298 of the ground conductors 292 and the mounting ends 314, 344 of the ground shields 200, 202 form a C-shaped shield around the pairs of contact tails 252. Other configurations of openings 474, 475 are possible in alternative embodiments.

The contact spacer 470 holds the contact tails 252 at predetermined positions for mating with the circuit board 106 (shown in FIG. 1). The contact spacer 470 is coupled to all of the contact modules 122 after all of the contact modules 122 are received in the front housing 120. The receptacle assembly 102 may then be mounted to the circuit board 106 as a unit, such as with the gasket 402 positioned therebetween.

The circuit board gasket 402 is coupled to the bottom of the contact spacer 470. The circuit board gasket 402 includes a first mounting surface 430 that is configured to be mounted to, and engage, the shield structure 126. The circuit board gasket 402 includes a second mounting surface 432 opposite the first mounting surface 430 that is configured to engage a ground plane or ground vias of the circuit board 106 (shown in FIG. 1). The circuit board gasket 402 is conductive and defines a ground path therethrough. As such, the shield structure 126 is electrically grounded to the circuit board 106 through the conductive circuit board gasket 402.

The circuit board gasket 402 includes longitudinal strips 434 and lateral strips 436 extending between the longitudinal strips 434. The mounting ends 314, 344 of the ground shields 200, 202 are configured to engage the longitudinal strips 434 and/or the lateral strips 436. For example, the mounting ends 314, 344 (e.g. the bottom edges) of the side shields 302, 332 (shown in FIG. 6) engage the longitudinal strips 434 while the mounting ends 314, 344 of the shield tabs 306, 336 engage the lateral strips 436. The mounting ends 298 (shown in FIG. 5) of the ground conductors 292 (shown in FIG. 5) engage the lateral strips 436.

In an exemplary embodiment, the circuit board gasket 402 includes an elastomeric sheet that is compressible to define a compressible interface between the shield structure 126 and the circuit board 106. The elastomeric sheet is conductive to define a conductive pathway between the first and second mounting surfaces 430, 432. For example, the circuit board gasket 402 may be fabricated from a compliant plastic or rubber material having conductive filler, a conductive plating, a conductive coating and the like. Alternatively, the circuit board gasket 402 may be fabricated from a conductive fabric, such as a woven mesh. In other alternative embodiments, the circuit board gasket 402 may be fabricated from a metallic plate, metallic strips, or a metallic mold or die. In such embodiments, the circuit board gasket 402 may include compressible elements, such as spring fingers, to ensure contact between the circuit board gasket 402 and the shield structure 126 and/or the circuit board 106.

With reference to the Figures and above description, embodiments described herein provide optimum shielding for the pairs of receptacle signal contacts 124. For example, through the receptacle assembly 102, the ground leadframes 204, 206 provide shielding between pairs of the receptacle signal contacts 124 of the corresponding contact module. The ground shields 200, 202 provide shielding along the sides of the receptacle signal contacts 124, thereby providing shielding between pairs of receptacle signal contacts 124 held by adjacent contact modules. The frame assembly 214 does not need to be conductive, as the ground leadframes 204, 206 and ground shields 200, 202 provide 360° shielding around each pair of receptacle signal contacts 124 between the mating and mounting interfaces of the receptacle assembly 102 (e.g. the interfaces with the header assembly 104 and the circuit board 106). The gaskets 400, 402 provide ground paths to the header assembly 104 and circuit board 106, respectively. The gaskets 400, 402 continue the 360° shielding around the pairs of receptacle signal contacts 124 through such interfaces.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a front housing having a mating end and a loading end; and a contact module coupled to the loading end of the front housing, the contact module comprising:

a frame assembly including a plurality of contacts and a dielectric frame supporting the contacts, the dielectric frame having first and second sides, the dielectric frame having channels between the contacts extending at least partially through the dielectric frame between the first and second sides, the contacts extending from the dielectric frame for electrical termination;

ground conductors received in corresponding channels and providing electrical shielding between corresponding contacts; and a ground shield coupled to the first side, the ground shield having side shields extending along sides of the contacts to provide electrical shielding along sides of the contacts, the ground shield having shield tabs bent into the channels for engaging corresponding ground conductors to electrically connect the ground shield to the ground conductors.

2. The receptacle assembly of claim 1, wherein the contacts are held in the dielectric frame along a contact plane, the ground conductors being received in the channels such that the ground conductors lie at least partially in the contact plane.

3. The receptacle assembly of claim 1, wherein the contacts are held in the dielectric frame along a contact plane, the ground conductors providing shielding within the contact plane, the ground shield providing shielding along a shield plane parallel to the contact plane.

4. The receptacle assembly of claim 1, wherein the ground conductors have opposite first and second sides being parallel to the first and second sides of the dielectric frame, the first and second sides of the ground conductors extending no further than the first and second sides, respectively, of the dielectric frame such that the ground conductors are completely contained within the dielectric frame.

5. The receptacle assembly of claim 1, wherein the ground conductors provide shielding above and below corresponding contacts and the ground shield provides shielding along the sides of the contacts.

6. The receptacle assembly of claim 1, wherein the ground shield is a stamped and formed ground shield with the shield tabs bent out plane with respect to the side shields, the shield tabs being spring biased against the ground conductors when the ground shield is coupled to the dielectric frame.

7. The receptacle assembly of claim 1, wherein the dielectric frame includes slots extending between the channels and the first side, the shield tabs being received in, and extending through, corresponding slots to engage the ground conductors.

8. The receptacle assembly of claim 1, wherein the ground conductors are initially held together, and loaded into the dielectric frame, as a ground lead frame with each of the ground conductors connected together by a carrier, the carrier being removed after the ground conductors are loaded into the channels.

9. The receptacle assembly of claim 1, wherein the ground shield has a mating end and a mounting end, the ground conductors having mating ends and mounting ends, the receptacle assembly further comprising a conductive mating gasket and a conductive circuit board gasket, the mating ends of the ground shields and ground conductors engaging the mating gasket, the mounting ends of the ground shield and ground conductors engaging the circuit board gasket.

10. A receptacle assembly comprising:

a front housing having a mating end and a loading end; and a contact module coupled to the loading end of the front housing, the contact module comprising:

a frame assembly including a plurality of contacts, the frame assembly including a first dielectric frame supporting at least some of the contacts and a second dielectric frame supporting at least some of the contacts, the first and second dielectric frames each having opposite interior and exterior sides, the interior sides facing one another, the first and second dielectric frames each having channels located between corresponding contacts, the channels being open at the interior sides and extending at least partially through the first and second dielectric frames between the interior and exterior sides, the contacts extending from the first and second dielectric frames for electrical termination;

first ground conductors received in corresponding channels of the first dielectric frame and providing electrical shielding between corresponding contacts supported by the first dielectric frame, each of the first ground conductors being completely contained within the corresponding channels of the first dielectric frame;

second ground conductors received in corresponding channels of the second dielectric frame and providing electrical shielding between corresponding contacts supported by the second dielectric frame, each of the second ground conductors being completely contained within the corresponding channels of the second dielectric frame;

a first ground shield coupled to the exterior side of the first dielectric frame, the first ground shield having side shields extending along sides of the contacts of the first dielectric frame to provide electrical shielding along sides of such contacts, the first ground shield having shield tabs engaging corresponding first ground conductors to electrically connect the first ground shield to the first ground conductors; and a second ground shield coupled to the exterior side of the second dielectric frame, the second ground shield having side shields extending along sides of the contacts of the second dielectric frame to provide electrical shielding along sides of such contacts, the second ground shield having shield tabs engaging corresponding second ground conductors to electrically connect the second ground shield to the second ground conductors.

11. The receptacle assembly of claim 10, wherein the first ground shield directly engages the outer surface of the first dielectric frame, the second ground shield directly engages the outer surface of the second dielectric frame, the inner surfaces of the first and second dielectric frames directly engage one another, the ground conductors having opposite first and second sides being parallel to the interior and exterior sides of the corresponding first and second dielectric frames, the first and second sides of the ground conductors extending no further than the exterior sides of the first and second dielectric frames such that the ground conductors are completely contained within the first and second dielectric frames.

12. The receptacle assembly of claim 10, wherein the first ground conductors are discrete from the second ground conductors and the first ground conductors directly physically engage the second ground conductors to electrically connect the first and second ground conductors.

13. The receptacle assembly of claim 10, wherein the contacts are held in the first and second dielectric frames along first and second contact planes, respectively, the first ground conductors being received in the channels of the first dielectric frame such that the first ground conductors at least partially lie in the first contact plane, the second ground conductors being received in the channels of the second dielectric frame such that the second ground conductors at least partially lie in the second contact plane.

14. The receptacle assembly of claim 10, wherein the contacts are held in the first and second dielectric frames along first and second contact planes, respectively, the first ground conductors providing shielding within the first contact plane, the second ground conductors providing shielding within the second contact plane, the first ground shield providing shielding along a first shield plane parallel to the first contact plane, the second ground shield providing shielding along a second shield plane parallel to the second contact plane.

15. The receptacle assembly of claim 10, wherein the contacts and the first ground conductors are held in the first dielectric frame in an alternating sequence, and wherein the contacts and the second ground conductors are held in the second dielectric frame in an alternating sequence.

16. The receptacle assembly of claim 10, wherein the first ground conductors provide shielding above and below corresponding contacts in the first dielectric frame and the first ground shield provides shielding along the sides of the contacts in the first dielectric frame, and wherein the second ground conductors provide shielding above and below corresponding contacts in the second dielectric frame and the second ground shield provides shielding along the sides of the contacts in the second dielectric frame.

17. The receptacle assembly of claim 10, wherein the first dielectric frame includes slots extending between the channels and the exterior side, the shield tabs of the first ground shield being received in, and extending through, corresponding slots in the first dielectric frame to engage the first ground conductors, and wherein the second dielectric frame includes slots extending between the channels and the exterior side, the shield tabs of the second ground shield being received in, and extending through, corresponding slots in the second dielectric frame to engage the second ground conductors.

18. The receptacle assembly of claim 10, wherein the first and second ground shields have mating ends and mounting ends, the first and second ground conductors having mating ends and mounting ends, the receptacle assembly further comprising a conductive mating gasket and a conductive circuit board gasket, the mating ends of the first and second ground shields and the first and second ground conductors engaging the mating gasket, the mating ends of the first and second ground shield and the first and second ground conductors engaging the circuit board gasket.

19. A contact module for a receptacle assembly comprising:

a pair of dielectric frames surrounding and holding signal contacts, the signal contacts being arranged in pairs carrying differential signals, one contact in each pair being held by one of the dielectric frames and the other contact in each pair being held by the other dielectric frame;

ground conductors held by the dielectric frames, the ground conductors being positioned between the pairs of contacts; and a ground shield coupled to an exterior surface of one of the dielectric frames, the ground shield being separate and discrete from the ground conductors, the ground shield engaging corresponding ground conductors to electrically connect the ground shield to the ground conductors.

20. The contact module of claim 19, further comprising a second ground shield coupled to an exterior surface of the other dielectric frame, the second ground shield engaging corresponding ground conductors to electrically connect the second ground shield to such ground conductors.

* * * * *